US006679325B2

(12) United States Patent
Buytaert

(10) Patent No.: US 6,679,325 B2
(45) Date of Patent: Jan. 20, 2004

(54) MINIMUM CLEARANCE BOW-SPRING CENTRALIZER

(75) Inventor: Jean Buytaert, Houston, TX (US)

(73) Assignee: Frank's International, Inc., Houston, TX (US)

( * ) Notice: Subject to any disclaimer, the term of this patent is extended or adjusted under 35 U.S.C. 154(b) by 10 days.

(21) Appl. No.: 10/071,734

(22) Filed: Feb. 8, 2002

(65) Prior Publication Data

US 2003/0150611 A1 Aug. 14, 2003

(51) Int. Cl.[7] ..... E21B 17/10

(52) U.S. Cl. ..... 166/241.3; 166/174; 166/241.6; 175/325.5

(58) Field of Search ..... 166/172, 174, 166/213, 241.1, 241.3, 241.4, 241.6; 175/325.1, 325.5, 325.6, 325.7

(56) References Cited

U.S. PATENT DOCUMENTS 2,855,052 A * 10/1958 Wright et al. ..... 166/243
3,124,196 A * 3/1964 Solum ..... 166/241.6
3,200,884 A * 8/1965 Solum et al. ..... 166/241.6
4,531,582 A * 7/1985 Muse et al. ..... 166/241.7
4,787,458 A * 11/1988 Langer ..... 166/380
H1192 H * 6/1993 Keller ..... 166/241.6
5,238,062 A * 8/1993 Reinholdt ..... 166/241.7
5,261,488 A 11/1993 Gullet et al.
5,575,333 A 11/1996 Lirette et al.
6,457,519 B1 * 10/2002 Buytaert ..... 166/241.6
6,484,803 B1 * 11/2002 Gremillion ..... 166/241.6
2002/0139537 A1 * 10/2002 Young et al. ..... 166/378

FOREIGN PATENT DOCUMENTS

GB 2148985 A * 6/1985 ..... E21B/17/10

* cited by examiner

*Primary Examiner*—David Bagnell
*Assistant Examiner*—Jennifer H Gay
(74) *Attorney, Agent, or Firm*—Streets & Steele; Patrick K. Steele

(57) ABSTRACT

A centralizer apparatus for centralizing tubular casing in a borehole having two stop collars for securing to the casing in a spaced apart relationship and two moving collars, one slidably and rotatably coupled to each stop collar, a plurality of bow springs, each bow spring having a first end spaced apart from a second end, each bow spring biased outwardly from the center axis, the first ends connected to the first moving collar, the second ends connected to the second moving collar.

14 Claims, 7 Drawing Sheets

MINIMUM CLEARANCE BOW-SPRING CENTRALIZER

BACKGROUND OF THE INVENTION

1. Field of the Invention

This invention is directed to casing or tubular centralizers with flexible bow springs for use in bore bole drilling operations, and particularly to centralizers that can be radially compressed to fit within a small annular space and which can later expand to center casing within the bore hole.

2. Description of Related Art

Casing is tubular pipe used to line a bore hole that is drilled to recover naturally occurring oil or gas deposits. A joint of casing is typically about 36 to 44 feet in length, and generally has threaded connections at each end to facilitate coupling to adjacent joints of casing to form a casing string. Casing prevents drilled bore holes from washing out or caving in during subsequent drilling and completion operations. Casing strings are cemented into place in the bore hole by circulating cement from the surface down the interior of the casing string, and then displacing the cement into the annular space between the exterior surface of the casing string and the wall of the bore hole. It is important that the casing string be positioned prior to cementing as closely as possible to the center of the bore hole in order to ensure full circumferential cement placement around the casing and to thereby effectively isolate and seal off penetrated geologic formations and to prevent unwanted fluid flow. It is desirable to install casing periodically to maintain the bore hole, and the length of a casing string that can be effectively installed and cemented into place in the bore hole is limited. Progressively smaller diameter casing strings are lowered into the bore hole through the interior of previously installed and cemented casing. Consequently, progressively smaller diameter casing is installed as the depth of the drilled bore hole increases.

It is advantageous to case the bore hole adjacent to producible hydrocarbon zones with casing of a reasonably large diameter to facilitate completion and production operations. This advantage is achievable using bi-centered drill bits. Bi-centered drilling bits are drilling bits that can be used to drill a bore hole of a size larger than the inside diameter of cemented casing through which the drilling bit passes. For example, FIG. 1A illustrates a bore hole having casing 90 with 13⅜ inch outside diameter and 12¼ inch inside diameter. Using conventional drilling bits, the bore hole below the 12¼ inch I.D. casing 90 can be drilled only to 12¼ inch in diameter 71, and the largest standard size of casing that can be effectively installed and cemented in the bore hole is 9⅝ inch O.D. casing 82. However, using a bi-centered bit allows drilling the bore hole beneath the end of the 12¼ inch I.D. casing 90 to 14¾ inch diameter 72 as shown in FIG. 1B. This advance in drill bit technology allows 11⅞ inch O.D. casing 80 to be effectively cemented in place beneath the 12¼ inch I.D. casing 90 as an annulus 75 comparable to the annulus between the 9⅝ O.D. inch casing and the 12¼ O.D. inch bore hole in FIG. 1A is obtained around the 11⅞ inch O.D. casing in FIG. 1B.

The bore hole is easier to drill and complete if larger diameter tools can be used. As wells are drilled to deeper depths, and as more high angle and horizontal wells are drilled, the number of discrete sizes of casing used in the casing system increases, and the available annular clearance between adjacent strings of casing necessarily decreases. For example, referring again to FIG. 1B, if a bi-centered bit is used to drill the bore hole below a string of 12¼ inch I.D. casing 90 to 14¾ inch, and if 11⅞ inch O.D. casing 80 is lowered through the 12¼ inch I.D. casing 90 and into the 14¾ inch diameter 72 bore hole, the thickness of the annular clearance 74 between the inside of the (fixed) 12¼ inch casing 90 and the outside of the 11⅞ inch O.D. casing 80 is 3⁄16 inch. The use of bi-centered bits gives rise to the need for a centralizer that substantially radially collapses to fit within the thin 3⁄16 inch annular space 74, and that can later re-deploy to center the 11⅞ inch O.D. casing 80 in a 14¾ inch diameter 72 bore hole. However, as the thickness of the annular clearance 74 becomes very small, it becomes difficult to obtain optimal pre-cement centralization of casing 80 using conventional bow-spring centralizers because they require excessive annular clearance 74 between adjacent casing strings 90 and 80.

Bow-spring centralizers are used to center casing inside a drilled borehole in order to obtain uniform annular placement of cement in the casing/bore hole annulus 75. Bow springs extend radially outwardly from the center bore of the centralizer to provide desirable casing stand-off from the wall 76 of the bore hole. Wide-deployment centralizers are centralizers designed to provide substantial stand-off from a nearby object such as the wall of a bore hole. For example, centering a 11⅞ inch O.D. casing within a 14¾ inch diameter bore hole requires radial stand-off of about 1⁷⁄₁₆ inch. By comparison, a limited deployment centralizer may be used to center a 4½ inch O.D. diameter casing within a 5½ inch diameter bore hole, and requires only a radial stand-off of about 0.5 inch. While a limited stand-off centralizer may have bow springs that are sufficiently stiff to resist radially outward collapse upon being pushed into or through a restriction, most wide-deployment centralizers have bow springs that are flexible, and the leading ends of the bow springs must be secured against the casing in order to prevent radially outward collapse of the centralizer ribs. As shown in FIG. 2A and FIG. 2B, bow-spring centralizers are secured to the exterior of the casing and centralizer ribs project radially outwardly therefrom. In order to provide optimal centralization of casing installed at lower depths in the well, it is essential that centralizers be resiliently collapsible to fit within the annular space between the exterior surface of the casing being installed and the interior surface of the larger, installed casing. It is also desirable that the centralizer ribs 42 collapse radially inwardly to achieve a minimum annular clearance, and that the centralizer does not prevent the flow of drilling fluid through the annulus between the smaller and larger casing.

Another factor to be considered in designing a low annular clearance centralizer is the prevention of centralizer rib damage. No wellbore is perfectly vertical and uniform. As casing is lowered into a well, the high strength steel resiliently twists, turns and flexes as it passes through restrictions and bends in the non-linear and non-uniform bore hole. It is important to prevent damage to centralizer ribs by securing the centralizer to the casing in a manner that allows free rotation of the centralizer relative to the casing to which it is secured.

Another factor to be considered in designing low annular clearance centralizers is related to securing the centralizer in place on the exterior of casing that is to be lowered into the well. As the bow springs radially inwardly collapse, the ends of each bow spring must longitudinally separate one from the other. Longitudinal elongation of the centralizer requires that at least one of the collars to which the end of bow springs are secured must remain longitudinally movable relative to the casing on which the centralizer is secured. If the other collar is secured to the casing, then the centralizer will be unidirectional; that is, the centralizer ribs will collapse only when the centralizer passes through a restriction in one direction, and the centralizer ribs will not collapse and pass through the larger casing unless the collar that is secured to the casing is the leading collar to first enter the larger, installed casing. However, a centralizer needs to be bi-directional in order to allow casing to be reciprocated or withdrawn from the bore hole if problems arise during casing installation, and this requires that collars at each end of the bow springs be longitudinally movable relative to the casing.

One attempt to provide a bi-directional centralizer involves the fixed placement of a stop collar longitudinally between sliding end collars secured to the ends of the bow springs, and securing the stop collar to the exterior of the casing to be centralized in the bore hole. This configuration provides the desirable bi-directional function of the centralizer because the centralizer will slide along the casing as the ribs resist collapse and entry into the larger casing until the leading end collar abuts against the stop collar. The ribs will then flatten as they enter the opening or restriction, and the longitudinal elongation of the centralizer slidably displaces the trailing end collar in a direction away from the leading end collar abutted against the stop collar.

The problem with locating a stop collar longitudinally between sliding end collars is that the thickness of the stop collar prevents the centralizer ribs from completely radially inwardly collapsing to lie flat along the length of the casing to which the centralizer is slidably secured. This design causes the stop collar to consume valuable annular space and thereby prevents optimal sizing of subsequent casing.

Attempts have been made to develop low annular clearance centralizers; that is, centralizers that collapse radially inwardly to fit within a thin annulus. U.S. Pat. No. 5,575,333 discloses a bow spring centralizer that integrates the bow springs into a specially manufactured thin-walled tubular member, or sub, that threadably couples at each end to standard joints of casing. These tubular members have very thin-walls of high strength material. A problem with the centralizer disclosed in the '333 patent is that the centralizer ribs are not freely rotatable about the joint of casing to which the centralizer is secured and are, therefore, subject to breakage and damage as the casing is lowered into the bore hole. Broken ribs may cause the casing to be cemented off-center in the bore hole, thereby greatly increasing the likelihood of fluid flow behind casing, casing failure and loss of productivity of the well. Also, broken centralizer ribs may obstruct the bore hole and prevent installation of casing on completion of the well. Another problem with the centralizer disclosed in the '333 patent is that the overall mechanical integrity of the resulting non-uniform casing string is compromised by the inclusion of the non-standard, thin-walled subs. It is desirable to use casing that conforms to standards promulgated by the American Petroleum Institute (API), and the necessity of installing thin-walled subs requires frequent interruptions in drilling and completion operations. Another problem with the centralizer disclosed in the '333 patent is that the use of centralizing subs inhibits the placement of centralizers in close proximity one to the other without specially fabricated subs made to accommodate two centralizers in close proximity or specially fabricated subs of varying lengths.

What is needed is a low annular-clearance bi-directional bow-spring centralizer that can be secured to the exterior surface of a joint of standard casing, radially compressed to its annular configuration, and passed along with the casing through the interior of a slightly larger diameter casing, and later radially outwardly deployed within the lower, uncased bore hole to centralize the casing. What is needed is a centralizer that radially collapses to fit within a very thin annular space, and one that still permits sufficient flow of drilling fluid through the annular space between the smaller and the larger casing to reduce risks of swabbing or surging the well as casing is run into or withdrawn from the bore hole.

SUMMARY OF THE PRESENT INVENTION

One embodiment of the present invention provides a bi-directional low annular clearance bow-spring centralizer having, at each end, a displacement assembly comprising a moving collar and a stop collar, and a longitudinal bore therethrough to accommodate the casing to which the centralizer is secured. Each moving collar has a collet with a radially outwardly flanged portion thereon that is movably received within a circumferential groove or bore within its mating stop collar. A plurality of flexible bow springs, each having a first end and a second end, are secured at each end to a moving collar, and the two moving collars are maintained in a variable spaced-apart relationship by the bow springs. The variance in the longitudinal distance between the two opposing moving collars is determined by the configuration of the bow springs. The longitudinal distance between the moving collars is smallest when the bow springs are in their radially outwardly deployed configuration as shown in FIG. 2A and FIG. 2B, and the longitudinal distance between the moving collars is greatest when the bow springs are radially inwardly collapsed so as to be substantially flattened along the exterior length of the casing to which the centralizer is secured. The position of the flanged portion of each moving collar within the circumferential groove or bore of its mating stop collar is determined by the configuration of the bow springs and by the mechanical interaction between the leading end of centralizer and the larger, cemented and installed casing string through which the centralizer passes.

One embodiment of the present invention provides for each stop collar adapted for having three distinct internal bores of differing diameters: the securing bore, the receiving bore and the reciprocation bore, from smallest to largest. The securing bore is sized for securing the centralizer to the exterior circumferential surface of the casing to be centered in the bore hole using the centralizer. The receiving bore is sized to slidably receive the exterior generally cylindrical surface of the collet of the mating moving collar. The larger diameter reciprocation bore is disposed between the securing bore and the receiving bore, and is adapted to accommodate longitudinal reciprocation of a radially flanged portion on the collet of the mating moving collar.

One embodiment of the present invention provides for each moving collar being longitudinally movable relative to its mating stop collar to accommodate longitudinal displacement of the ends of the bow springs. The range of longitudinal movement of the moving collar within its mating stop collar is limited in one direction by a stop wall in the reciprocation bore and in the other direction by the collapsed and flattened length of the bow springs. Each bow spring is radially outwardly biased towards its deployed configuration, bowed away from the center axis of the casing to which the centralizer is secured. The stop collars are secured to the casing at a distance one from the other such that, when the bow springs are in their fully deployed configuration, the radially flanged portion on the collet of the moving collar is in its extreme inboard position abutted against the stop wall of the reciprocation bore of the stop collar. The bow springs collapse toward the longitudinal center of the centralizer as the bow springs are forced radially inwardly by contact with the surface of a bore hole or with the interior wall of larger casing. In the preferred embodiment, the bow springs flexibly collapse to lie substantially flat along the exterior longitudinal length of the casing to which the centralizer is secured.

In the preferred embodiment, each end of each bow spring is secured to a moving collar, and each moving collar is rotatably and slidably coupled to its mating stop collar, so that each end of each bow spring is longitudinally movable relative to the casing to which the centralizer is secured. The stop collars of the centralizer may be secured to the external surface of the casing using a variety of securing means. The stop collars may be heat shrunk onto the casing, adhered to the casing using epoxies or other adhesives, or secured in place by using welding or using connective pins or set screws. Alternately, stop collars may be made in two or more angular pieces, emplaced together to substantially encircle the casing and secured together to form a collar by welding, adhesives, epoxies, or by using connective pins or set screws.

The present invention may be adapted for centering down hole tools that are lowered into the well using a wireline. Many wireline tools need to be centered in the bore hole for optimal performance, and are lowered into the bore hole through restrictions such as tubulars or bore hole deviations. The present invention provides for centralization of wireline tools while maintaining down hole access by wireline and through instructions.

Optionally, the centralizer of the present invention may be used to position an elongate body within a bore hole at a place other than at the center. For example, the centralizer of the present invention may provide only one radially outwardly extending flexible rib for biasing a tool, such as a survey tool, perforating gun, resistivity through-casing tool or other wire line tool, against the interior longitudinal surface of the casing or bore hole in which the tool is disposed. In this application, the present invention may include a device for decentralizing or biasing a tool, and the minimum annular clearance aspect of the present invention is applicable to this use.

The present invention provides a bi-directional, freely rotatable and a radially collapsible centralizer for centralizing a joint of casing to which the centralizer is secured when the casing is lowered into a bore hole. The present invention provides a centralizer that is freely rotatable and substantially radially collapsible to fit within a very thin annular space between two generally concentric casing strings. The present invention provides a centralizer in which each bow spring is substantially collapsible to lie in a substantially flattened configuration along the longitudinal length of the exterior surface of a joint of casing to which the centralizer is secured. The present invention provides a centralizer with two spaced apart moving collars, each moving collar rotatably and slidably coupled to a mating stop collar that is adapted for securing the centralizer to the exterior surface of a joint of casing, and having a plurality of radially outwardly biased bow springs extending between the moving collars and secured at each end to a moving collar.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DETAILED DESCRIPTION

Figure 2A:
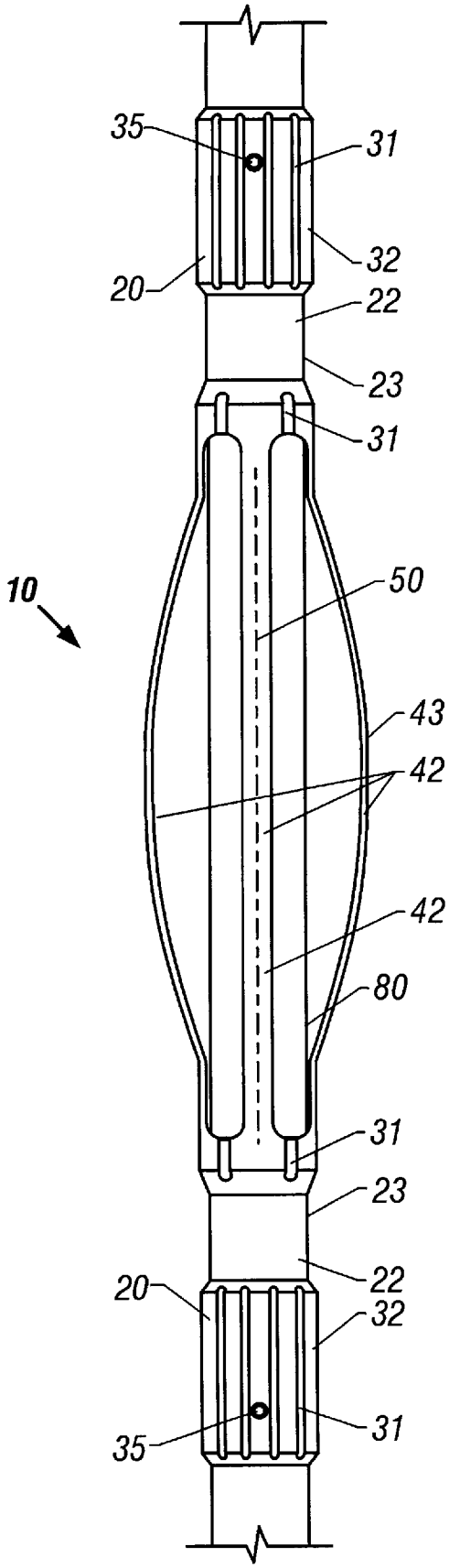
FIG. 2A is a side elevation view of a centralizer of the present invention.

A centralizer 10 according to the present invention as shown in FIG. 2A has two displacement assemblies 20, one at each end of the centralizer 10. Each displacement assembly 20 comprises a stop collar 32 having a bore centered at an axis 50 therethrough. The stop collar 32 is adapted for securing the centralizer 10 to the external surface of a tubular body such as a joint of casing received within the bore. The stop collar 32 is secured to the casing using set screws 35. The bow springs 42 are secured at each end to a moving collar 22 that is slidably and rotatably coupled to a mating stop collar 32.

Figure 2B:
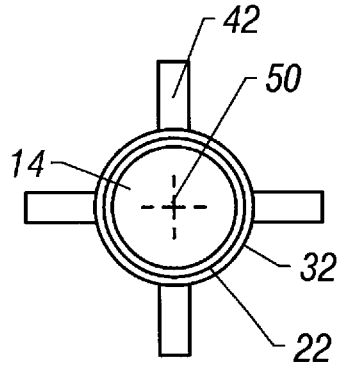
FIG. 2B is an end view of a centralizer of the present invention.

FIG. 2B is an end view of one embodiment of the centralizer 10 of the present invention having four ribs 42. The centralizer 10 of the present invention may have from as few as one to as many ribs as can be mechanically integrated, but the preferred number of ribs is between three and fourteen, more preferably from four to ten, inclusive. The centralizer 10 is generally centered about a center axis 50 which is in the center of the bore 14. The centralizer ribs 42 in FIG. 2A and FIG. 2B are biased towards and shown in their radially outwardly deployed configuration.

As the centralizer of the present invention is bi-directional, either displacement assembly of the centralizer may be placed in a leading position relative to the opposing displacement assembly; that is, either displacement assembly may be the first to enter a restriction, such as the end opening of casing or a deviation in the bore hole, depending on the direction of movement of the casing to which the centralizer is secured. For this reason, it is helpful to describe components that may be included in the centralizer as having an inner end and an outer end. The inner end would be the end that is longitudinally disposed towards the center of the centralizer; that is, towards the ribs. The outer end would be the end that is disposed longitudinally away from the ribs.

Figure 3A:
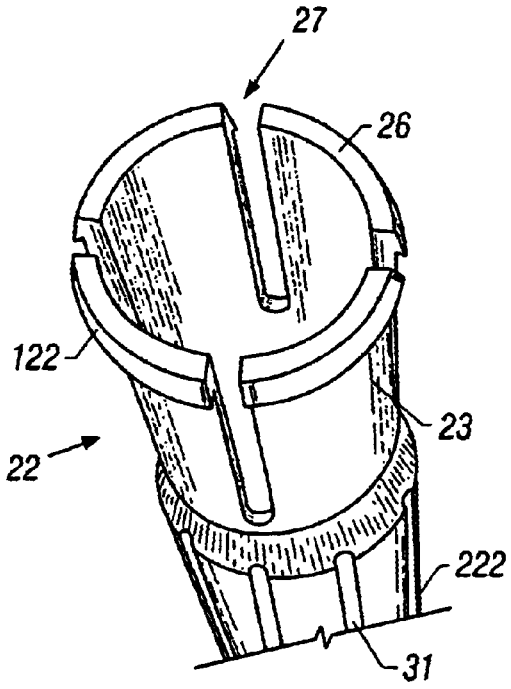
FIG. 3A is a perspective view of the outer end of one embodiment of the flanged collet of the moving collar of the centralizer of the present invention.

FIG. 3A is a perspective view of one embodiment of the flange-type moving collar 22 of the present invention. Each moving collar 22 has an outer end 122 and an inner end 222, the inner end 222 being longitudinally disposed toward the ribs 42 (see FIG. 2A) of the centralizer 10, and the outer end 122 being longitudinally disposed toward and received into the inner end 232 of the stop collar 32 (see FIG. 3B). The moving collar 22 has a collet 23 disposed on its outer end 122 that is slidably and rotatably received in the receiving bore 37 of stop collar 32. A plurality of bow springs 42 (see FIG. 2A), each having two ends and an outwardly bowed center portion 43, are coupled at their ends to the inner end 222 of the moving collar 22. The moving collar 22 shown in FIG. 3A has a radially outwardly protruding flange 26 disposed on the collet 23 of the moving collar 22. The collet 23 also has a plurality of longitudinal channels 27 machined along its length. The inner end 222 of the moving collar 22 is adapted for coupling to a plurality of flexible ribs 42 (see FIG. 2A). The longitudinal grooves 31 in the exterior surface of the moving collar 22 are adapted for improving fluid flow within the annulus formed between the exterior surface of the moving collar 22 and the interior wall of the casing in which the centralizer collapses. The channels 27 are adapted for imparting limited radial inward collapsibility to the collet 23 of the moving collar 22 for being received into the receiving bore 37 and coupling with the stop collar 32. The channels 27 in the collet 23 also improve fluid flow within the annulus in which the centralizer collapses.

It should be noted that when the centralizer 10 of the present invention is secured to the exterior surface of a joint of casing 80 (see FIG. 2A) of the proper size, the displacement assembly becomes self-locking; that is, the casing 80, when received within the bore of the moving collar 22, prevents the collet 23 from radially inward collapse, thereby locking the flange 26 into the reciprocating bore 34 of the stop collar 32. This self-locking design prevents inadvertent release of the moving collar 22 from the stop collar 32 while the centralizer 10 is secured to a joint of casing 80. In this configuration, the moving collar 22 can only be released from the stop collar 32 by a force sufficient to exceed the yield strength of the material of the flange 26, of the collet 23 adjacent to the flange 26 or at the reciprocation bore 34 of the stop collar 32.

Figure 3C:
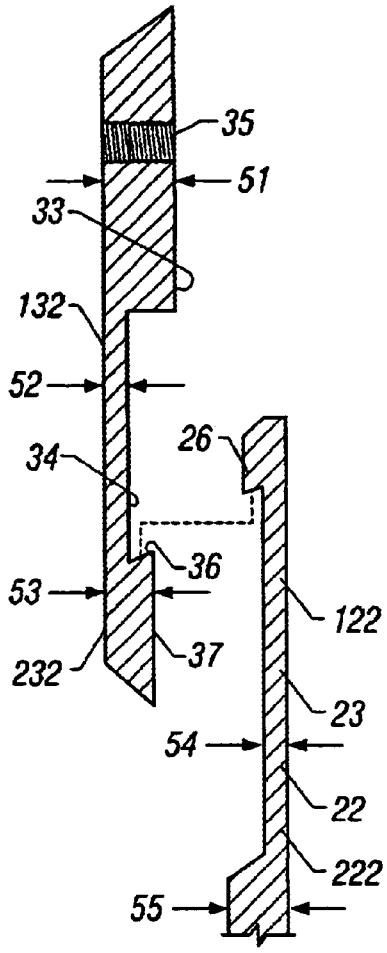
FIG. 3C is an illustration of the interaction of the cross-section of the wall of the moving collar of FIG. 3A with the wall of the stop collar of FIG. 3B.
Figure 3B:
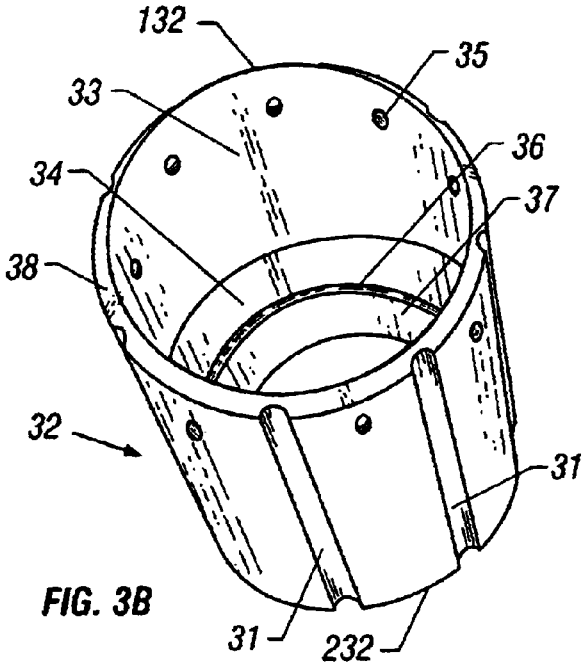
FIG. 3B is a perspective view of the outer end of one embodiment of the stop collar of the centralizer of the present invention.

FIG. 3B is a perspective view of the outer end 132 of the stop collar 32. The stop collar 32 has three or more generally concentric bores therethrough of different diameters: a securing bore 33, a reciprocating bore 34 having a stop wall 36, and a receiving bore 37. The stop wall 36 of the reciprocating bore 34 may be a shoulder, rim, node, upset or other structure defining the inwardly end of the reciprocating bore 34 by imposing an obstacle to further inward movement of the flange 26 of the moving collar 22. The flange 26 of the moving collar 22 (see FIG. 3A) is received into and reciprocates within the reciprocating bore 34 of the stop collar 32. The range of longitudinal reciprocation of the moving collar 22 relative to the stop collar 32 is limited in the direction toward the ribs 42 by the stop wall 36 of the reciprocating bore 34 and in the direction of the outer end 132 of the stop collar 32 by the flattened length of the ribs 42 (see FIG. 2A). When the centralizer 10 is in its relaxed, deployed configuration as shown in FIG. 2A, the flange 26 abuts against the stop wall 36 of the reciprocating bore 34. When the centralizer 10 is in its radially inwardly collapsed configuration with the ribs 42 substantially flattened along the longitudinal length of the exterior wall of the casing on which the centralizer 10 is secured, the flange 26 is at its maximum distance from the stop wall 36 within the reciprocation bore 34. The grooves 31 in the wall 38 of the stop collar 32, together with the longitudinal channels 27 in the collet 23, facilitate drilling fluid flow through the annulus to prevent inadvertent swabbing or surging of the bore hole during casing operations.

Figure 1A:
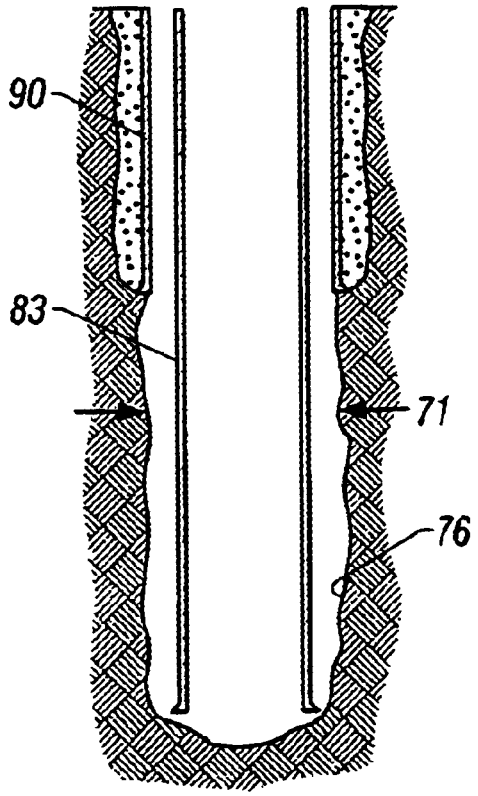
FIG. 1A (Prior Art)
FIG. 1A is an illustration of a bore hole having a string of 13⅜ inch O.D., 12¼ inch I.D. casing cemented in place and a portion of uncased bore hole beneath drilled to 12¼ inch in diameter using conventional drilling bits. The largest standard casing that can be effectively cemented into the 12¼ inch bore hole is 9⅝ inch O.D. casing.
Figure 1B:
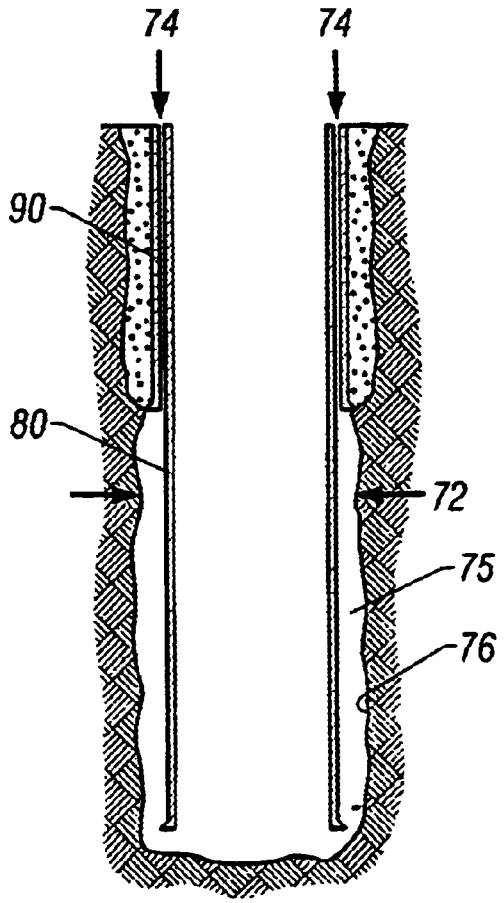
FIG. 1B (Prior Art)
FIG. 1B is an illustration of a bore hole having a string of 13⅜ inch O.D., 12¼ inch I.D. casing cemented in place and a portion of uncased bore hole beneath drilled to 14¾ inch in diameter using a bi-centered drilling bit. The largest standard casing that can be effectively cemented into the 14¾ inch bore hole is 11⅞ inch O.D. casing.

FIG. 3C shows the interaction of the cross-section of the wall of the moving collar of FIG. 3A with the wall of the stop collar of FIG. 3B. The relative thicknesses of the wall of the stop collar 32 and the wall of the moving collar 22 reveal the efficient use of annular space. In a centralizer adapted for use in the bore hole and casing shown in FIG. 1B, the stop collar 32 wall thickness would be approximately 3/16 inch for the securing bore wall 51, 1/16 inch for the reciprocating bore wall 52, 1/8 inch for the receiving bore wall 53, 1/16 inch for the collet wall 54 and 3/16 inch for the moving collar wall 55 adjacent to the point of coupling to the ribs 42.

It should be noted that the radially outwardly protruding flange 26, in its preferred embodiment, forms an acute angle with the portion of the collet 23 extending towards the inner end 222 of the moving collar 22. Preferably the angle formed by the radially outwardly protruding flange 26 and the collet 23 is less than 90 degrees and more than 45 degrees, and more preferably from 60 degrees to 80 degrees. The acute angle promotes better seating of the flange 26 in its abutting position against the stop wall 36 so that minor variations in the diameter of the casing do not compromise the seating of the flange 26.

Figure 4:
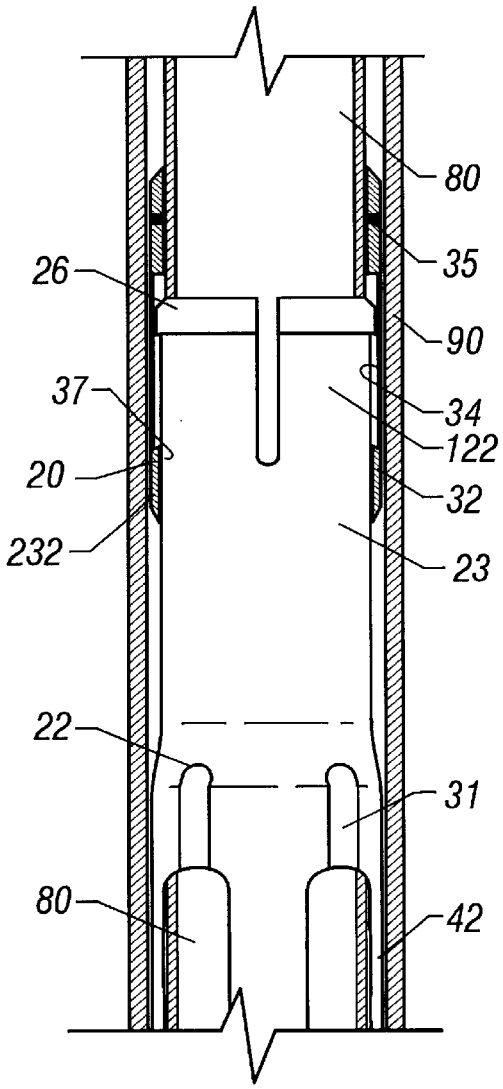
FIG. 4 is a side cross-sectional view of a displacement assembly of the present invention showing the interaction of a moving collar received with a stop collar.

FIG. 4 is a side cross-sectional view of the displacement assembly 20. The outer end 122 of the moving collar 22 is received within the inner end 232 of the stop collar 32. The securing bore 33 is adapted for securing the stop collar 32 to the external surface of a joint of casing 80. For example, the securing bore 33 of a stop collar 32 of a centralizer 10 for use in centralizing an 11 7/8 inch O.D. casing 80 would have an 11 7/8 inch bore. The receiving bore 37 of the stop collar 32 has a larger diameter than the securing bore 33 and is adapted for slidably and rotatably receiving the collet 23 of the moving collar 22. The reciprocating bore 34 of the stop collar 32 is designed to accommodate and limit reciprocation of the flange 26 and the moving collar 22 within the stop collar 32 by imposing an obstacle to longitudinal movement of the flange 26 in the direction of the ribs 42. When the ribs 42 of the centralizer 10 are in their radially outwardly deployed configuration as shown in FIG. 2A, the flange 26 of the moving collar 22 abuts against the stop wall 36 of the reciprocating bore 34. When the ribs 42 of the centralizer 10 are in their radially inwardly collapsed configuration, the flange 26 of the moving collar 22 may abut the inner wall 36 of the stop collar 32 or the flange 26 may be displaced away from the stop wall 36 towards the outer end 232 of the stop collar 32, depending on the direction of movement of the joint of casing 80 to which the centralizer 10 is secured. An advantage of the design of the displacement assembly 20 of FIG. 4 is that the internal location of the flange 26 within the reciprocation bore 34 prevents fouling and accumulation of debris that might otherwise obstruct smooth operation of the displacement assembly 20. Another advantage of the design of the displacement assembly 20 of FIG. 4 is that the ribs 42 and the moving collar 22 remain freely rotatable relative to the stop collar 32 and to the casing 80 to which the centralizer is secured. The position of the flange 26 within the reciprocating bore 34 when the centralizer 10 is in its radially inwardly collapsed configuration is explained further in connection with the FIG. 5, FIG. 6A and FIG. 6B.

Figure 5:
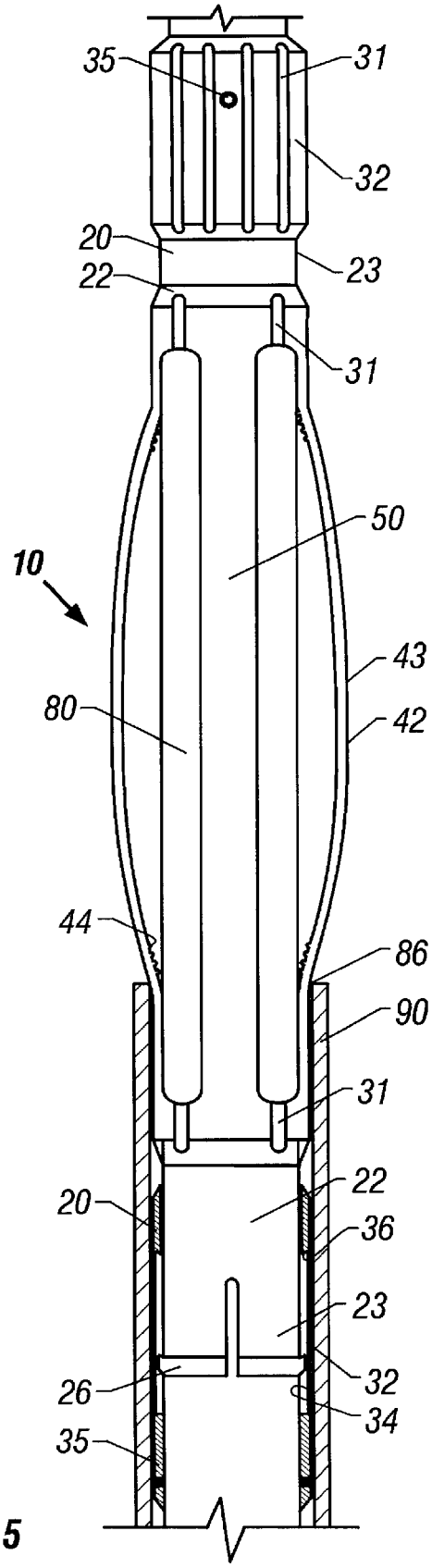
FIG. 5 is a side elevation view of a centralizer of the present invention secured to a joint of casing being drawn into the end of a larger casing.

FIG. 5 is a cross-sectional view of displacement assembly 20 of the centralizer 10 of the present invention secured to a joint of casing 80 and being introduced into an end opening 86 of larger casing 90. The centralizer 10 is secured to the casing 80 with the ribs 42 in their relaxed and outwardly deployed configuration and the moving collars 22 positioned longitudinally inward toward the ribs 42 with the flange 26 of the moving collar 22 abutting against the stop wall 36 of the reciprocation bore 34 of the stop collar 32, corresponding to the configuration of the displacement assembly shown in FIG. 4. It is possible that, after the centralizer ribs 42 have been radially compressed to their inwardly collapsed position to lie substantially flat along the length of the casing 80, the displacement assembly 20 may not fully return to the configuration shown in FIG. 4. Notwithstanding the relaxed configuration of the displacement assembly 20, upon initial contact of the ribs 42 with the end opening 86 of the casing 90 into which the centralizer 10 will be drawn, the moving collar 22 at the bottom and leading end of the centralizer 10 is forced towards its extreme withdrawn position within the stop collar 32, corresponding to the condition of the displacement assembly 20 shown in FIG. 4 with the flange 26 of the moving collar 22 abutting the stop wall 36 of the reciprocation bore 34. Once the flange 26 abuts against the stop wall 36 of the reciprocation bore 34, the adjacent ends of the bow springs 42 are longitudinally secured against further movement away from the leading stop collar shown already introduced into casing 90. Further movement of the lowered casing 80 into the larger casing 90 results in inwardly collapsing of the ribs 42, and the ribs 42 are progressively collapsed radially inwardly as the centralizer 10 and casing 80 move into the casing 90. The trailing moving collar 22 of the centralizer 10 (shown at the top of FIG. 5) is progressively displaced upwardly into its mating stop collar 32 as the bow springs 42 collapse to lie substantially flat along the length of the casing 80.

A plurality of teeth 44 are disposed on the radially inwardly surface of the ribs 42 at a position immediately adjacent to the point at which the end of the ribs 42 couple to the moving collar 22. Upon initial inward collapse of the ribs 42, the teeth engage the exterior surface of the casing 80 to provide additional gripping of the centralizer 10 to the casing 80. The teeth 44 may be ridges, surface roughness or a plurality of protrusions, and should be positioned to prevent interference with free rotation of the centralizer when in its deployed configuration.

Figure 6A:
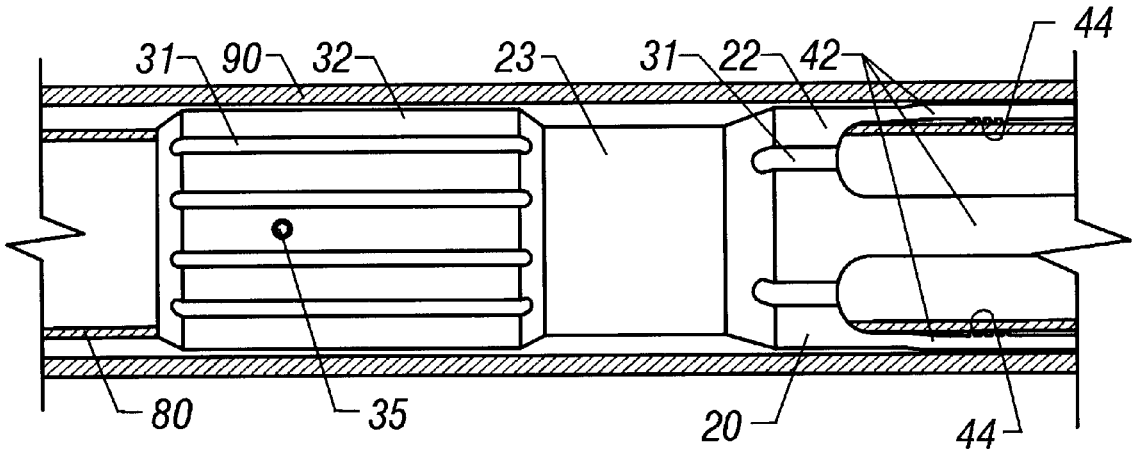
FIG. 6A is a side elevational view of a displacement assembly of the present invention in the leading position and secured to a joint of casing being moved through larger casing.

FIG. 6A is a slide elevational view of the leading (bottom) displacement assembly 20 of FIG. 5. A substantial portion of the collet 23 is exposed, thereby indicating that the moving collar 22 is in its extreme withdrawn position from the stop collar 32 and the flange 26 is in an abutting position against the stop wall 36 of the reciprocation bore 34 (see FIG. 4).

Figure 6B:
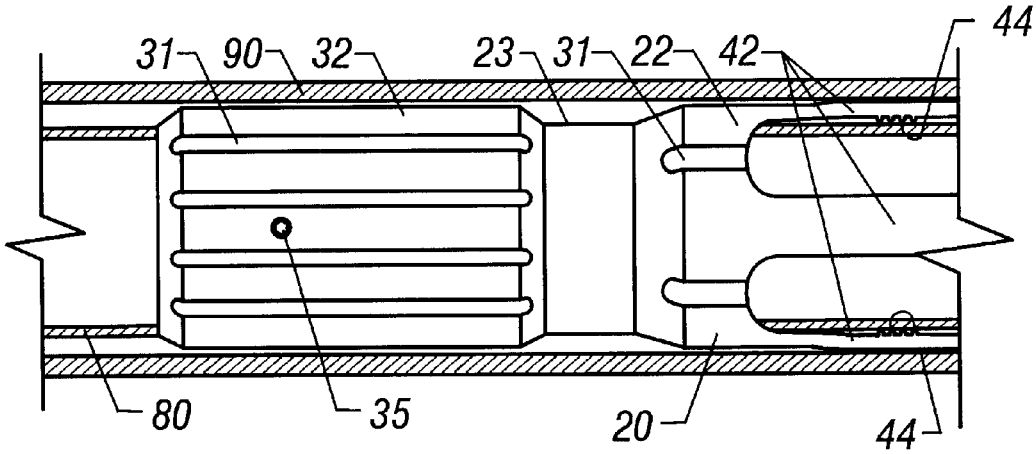
FIG. 6B is a side elevational view of a displacement assembly of the present invention in the trailing position and secured to a joint of casing being moved through larger casing.

FIG. 6B shows the position of the trailing displacement assembly 20 corresponding to the radially inwardly collapsed configuration of the ribs 42 of the centralizer 10 in which the ribs 42 are substantially flattened along the external length of the joint of casing on which the centralizer 10 is secured. FIG. 6B shows the trailing moving collar 22 at its extreme received position within the stop collar 32 and displaced towards the outer end 232 of the stop collar 32.

Figure 7:
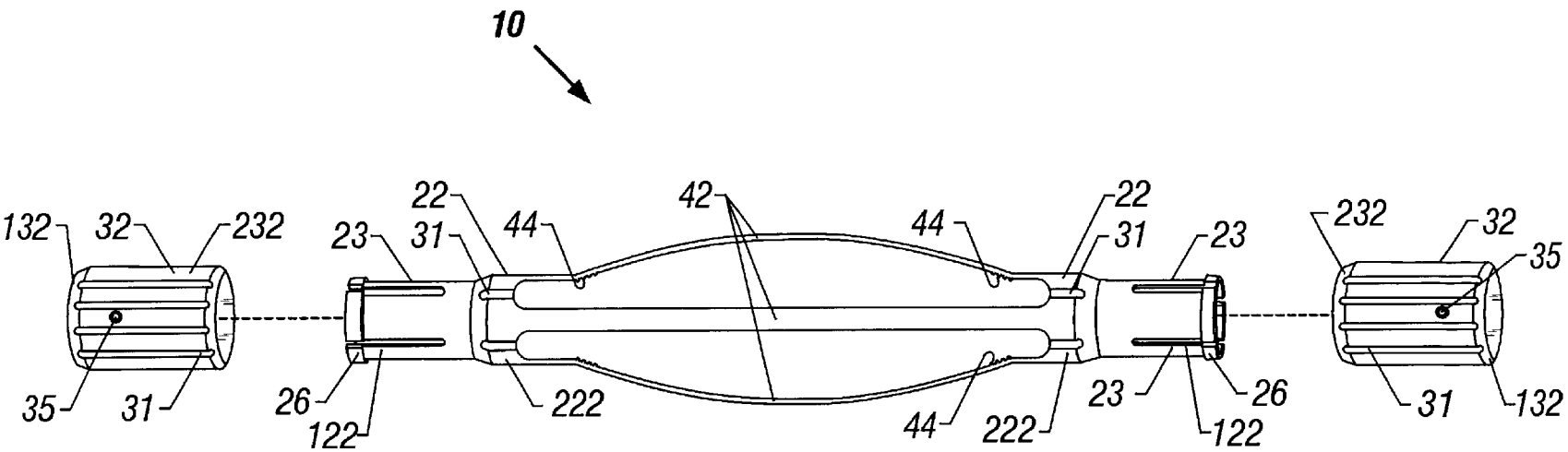
FIG. 7 is an exploded side elevational view showing the relationship among components of a centralizer of the present invention.

FIG. 7 is an exploded view of the centralizer 10 of the present invention. The moving collars 22 are shown coupled to each end of the ribs 42 of the centralizer 10, and longitudinally aligned with the stop collars 32 into which the moving collars 22 will be received upon assembly of the centralizer 10.

Figure 8:
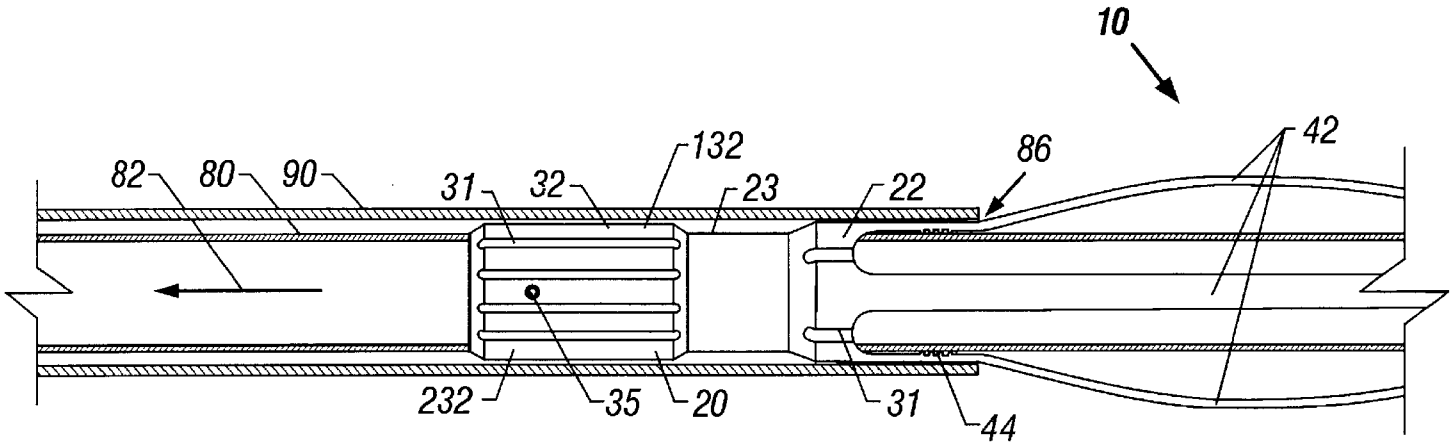
FIG. 8 is a side elevational view showing the configuration of the leading displacement assembly of a centralizer of the present invention secured to a joint of casing and being drawn into the end of a larger casing.

FIG. 8 shown the leading displacement assembly 20 of the centralizer 10 secured to a joint of casing 80 and being drawn, in the collapsing direction 82, into an end opening 86 of larger casing 90. The configuration of the displacement assembly 20 in FIG. 8 corresponds to FIG. 4 where the flange 26 is forced into an abutting position against the stop wall 36 near the inner end 132 of the stop collar 32 by the force of resistance of the ribs 42 to collapse and entry into the opening 86 of the casing 90. A plurality of rib teeth 44 disposed on the radially inward side of the ribs 42 promote securing of the centralizer 10 to the casing 80.

Figure 9:
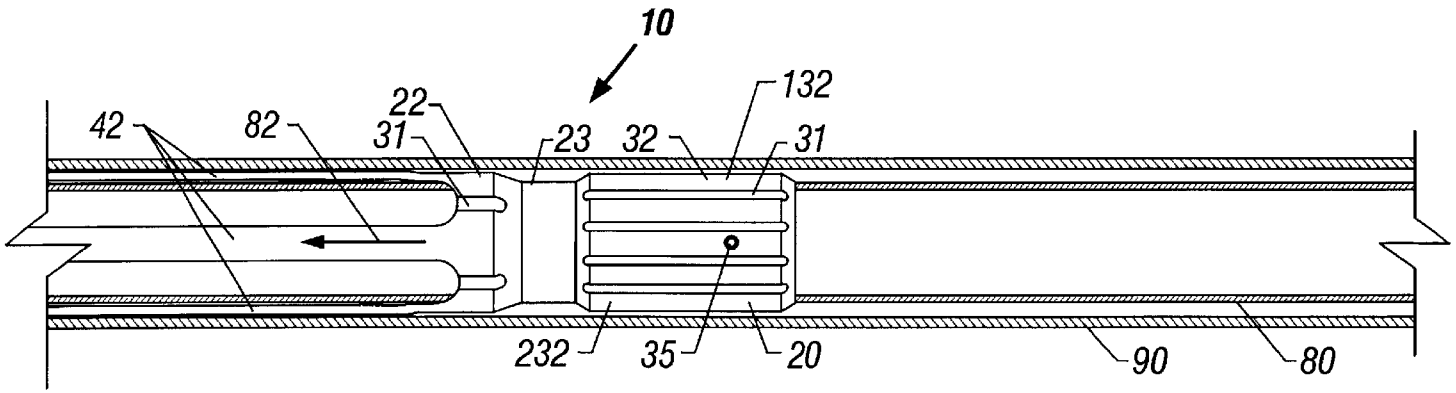
FIG. 9 is a side elevational view showing the configuration of the trailing displacement assembly of a centralizer of the present invention secured to a joint of casing and being moved through larger casing.

FIG. 9 shows trailing end of the displacement assembly 20 that is at the opposite end of the centralizer 10 from the displacement assembly 20 shown in of FIG. 8, but after the entire centralizer 10 has been drawn into the casing 90. In FIG. 9, the displacement assembly 20 at the trailing end of the centralizer 10 accommodates the longitudinal expansion of the ribs 42 as the ribs 42 collapse radially inwardly to lie substantially flat along the casing 80. The collet 23 of the moving collar 22 of the trailing displacement assembly 20 is slidably received to its extreme position towards the outer end 132 of the stop collar 32. The flange 26 does not necessarily contact the end of the reciprocation bore 34 opposite the stop wall 36 because the stroke of the flange 26 is limited by the flattened length of the ribs 42; that is, with the flange 26 of the collet 23 of the leading moving collar 22 (see FIG. 8) abutted against the stop wall 36, the position of the flange 26 in the trailing moving collar 22 (see FIG. 9) is determined by the flattened length of the ribs 42 as they compress radially inwardly to lay flat along the length of the casing 80.

It should be noted that is within the scope of the present invention to reverse the structures of the displacement assembly components. For example, the collet and flange may be disposed on the stop collar, and the mating receiving bore and reciprocating bore may be disposed on the moving collar to receive the collet and flange, respectively. This reversed arrangement provides the same advantages as the structures described above and depicted in the appended drawings.

It should be noted that the present invention is equally useful with centralizers having spiral ribs as it is to those having ribs that are longitudinally aligned with the bore through the centralizer. Those skilled in the art will recognize that the advantages obtained using the present invention are equally attainable with centralizers having spiral ribs because the freely rotatable moving collar accommodates angular or rotational displacement of collapsing or deployment of spiral centralizer ribs.

Centralizers and all parts thereof may be made of any suitable high strength material including, but not limited to, metal, plastic, fiberglass, composites, aluminum or aluminum alloys, brass, copper, zinc or zinc alloys. However, given that there is sliding movement between the external surface of the moving collar and the receiving bore of the stop collar, and between the internal bore of the moving collar and the external surface of the casing, the selection of materials should be done to prevent or minimize wear and galling. One embodiment of the present invention provides an alloy of beryllium copper for the stop collar and steel for the moving collar. This materials selection is favorable for centralizers having steel ribs and integral couplings between the ribs and the moving collar. Other embodiments may utilize other self-lubricating materials. These materials may be switched between the sliding components or other suitable materials may be used.

In certain embodiments of the present invention it is preferred that the parts, grooves, and recesses are sized, configured, and disposed so that the collars and bow springs, upon collapse of the bow springs against the casing, do not project beyond the exterior surface of the stop collar In conclusion, therefore, it is seen that the present invention and the embodiments disclosed herein and those covered by the appended claims are well adapted to carry out the objectives and obtain the benefits thereof set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps.

What is claimed is:

1. A centralizer comprising:

a plurality of bow springs coupled between first and second moving collars, the bow springs being characterized by a deployed condition and an elongated condition; and first and second stop collars slidably and rotatably coupling to the first and second moving collars and adapted to be securable to a tubular member, wherein the stop collars limit the longitudinal travel of the moving collars when biased toward the opposing stop collar, yet the stop collars allow the moving collars limited movement away from the opposing stop collar to allow the bow springs to radially inwardly collapse to their elongated condition.

2. The centralizer of claim 1 wherein the maximum diameter of first and second stop collars is not larger than the maximum diameter of the centralizer at the bow springs when the centralizer is in its radially inwardly collapsed configuration.

3. A centralizer comprising:

a first stop collar spaced apart from a second stop collar and each adapted for securing to a tubular member;

a first moving collar slidably and rotatably coupled to the first stop collar;

a second moving collar slidably and rotatably coupled to the second stop collar; and a plurality of flexible bow springs, each having a first end and a second end, the first end of each bow spring coupled to the first moving collar and the second end of each bow spring coupled to the second moving collar, thereby maintaining the first moving collar and the second moving collar in a variable spaced apart relationship one from the other, each bow spring further having a radially outwardly deployed configuration and a radially flattened configuration.

4. The centralizer of claim 3 further comprising teeth disposed on the radially inward side of each rib immediately adjacent to the coupling of the first end to the first moving collar and immediately adjacent to the coupling of the second end to the second moving collar.

5. The centralizer of claim 3 wherein the maximum diameter of the first and second stop collars is not larger than the maximum diameter of the centralizer at the bow springs when the centralizer is in its radially inwardly collapsed configuration.

6. A centralizer comprising:

a first stop collar adapted for slidably and rotatably coupling to a first moving collar;

a second stop collar adapted for slidably and rotatably coupling to a second moving collar;

a first flange bore in the first stop collar adapted for slidably and rotatably receiving a flange on the first moving collar, the first flange bore having a stop wall disposed toward the second stop collar;

a second flange bore in the second stop collar adapted for slidably and rotatably receiving a flange on the second moving collar, the second flange bore having a stop wall disposed toward the first stop collar; and a plurality of bow springs, each bow spring having a first end spaced apart from a second end, each first end of each bow spring coupled to the first moving collar and each second end of each bow spring coupled to the second moving collar, each bow spring biasing the flange on the first moving collar toward the stop wall in the first flange bore and the flange on the second moving collar toward the stop wall in the second flange bore.

7. The centralizer of claim 6 wherein the first stop collar and the second stop collar have a maximum diameter that is not larger than the diameter of the maximum diameter of the centralizer at the bow springs when the centralizer is in its radially inwardly collapsed configuration.

8. The centralizer of claim 6 further comprising teeth disposed on the radially inward side of each rib immediately adjacent to the coupling of the first end to the first moving collar and immediately adjacent to the coupling of the second end to the second moving collar.

9. A centralizer comprising:

a first displacement assembly having a stop collar and a moving collar spaced apart from a second displacement assembly having a stop collar and a moving collar, each displacement assembly having a bore therethrough for receiving a tubular member;

each moving cellar having a flange slidably and rotatably received within a reciprocating bore in the stop collar for coupling of the moving collar to the stop collar;

a plurality of bow springs, each having a first end coupled to the moving collar of the first displacement assembly and a second end coupled to the moving collar of the second displacement assembly, each bow spring radially outwardly biased away from the center of the bore;

wherein the longitudinal expansion of the bow springs upon being radially inwardly displaced toward the center of the bore moves the moving collar of the first displacement assembly to a position further from the moving collar of the second displacement assembly.

10. The centralizer of claim 9 wherein the maximum diameter of the first and second displacement assemblies is not larger than the maximum diameter of the centralizer at the bow springs when the centralizer is in its radially inwardly collapsed configuration.

11. The centralizer of claim 9 further comprising teeth disposed on the radially inward side of each bow spring immediately adjacent to the coupling of the first end of each bow spring to the first displacement assembly and immediately adjacent to the coupling of the second end of each bow spring to the second displacement assembly.

12. A centralizer comprising:

a first stop collar adapted for slidably and rotatably coupling to a first moving collar;

a second stop collar adapted for slidably and rotatably coupling to a second moving collar;

a first flange bore in the first moving collar adapted for slidably and rotatably receiving a flange on the first stop collar, the first flange bore having a stop wall disposed toward the first stop collar;

a second flange bore in the second moving collar adapted for slidably and rotatably receiving a flange on the second stop collar, the second flange bore having a stop wall disposed toward the second stop collar; and a plurality of bow springs, each bow spring having a first end spaced apart from a second end, each first end of each bow spring coupled to the first moving collar and each second end of each bow springs coupled to the second moving collar, each bow spring biasing the flange on the first stop collar toward the stop wall in the first flange bore and biasing the flange on the second stop collar toward the stop wall of the second flange bore.

13. The centralizer of claim 12 wherein the maximum diameters of the first and second moving collars is not larger than the maximum diameter of the centralizer at the bow springs when the centralizer is in its radially inwardly collapsed configuration.

14. The centralizer of claim 12 further comprising teeth disposed on the radially inward side of each rib immediately adjacent to the coupling of the first end of each bow springs to the first moving collar and immediately adjacent to the coupling of the second end of each bow spring to the second moving collar.

* * * * *

UNITED STATES PATENT AND TRADEMARK OFFICE

CERTIFICATE OF CORRECTION

PATENT NO. : 6,679,325 B2
APPLICATION NO. : 10/071734
DATED : January 20, 2004
INVENTOR(S) : Jean Buytaert It is certified that error appears in the above-identified patent and that said Letters Patent is hereby corrected as shown below:

In Claim 9, replace "cellar" with "collar".

Signed and Sealed this

Twentieth Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 6,679,325 B2
APPLICATION NO. : 10/071734
DATED : January 20, 2004
INVENTOR(S) : Jean Buytaert It is certified that error appears in the above-identified patent and that said Letters Patent is hereby corrected as shown below:

In Claim 9, Column 12, line 60, replace "cellar" with "collar".

This certificate supersedes the Certificate of Correction issued July 20, 2010.

Signed and Sealed this

Thirty-first Day of August, 2010

David J. Kappos

David J. Kappos
*Director of the United States Patent and Trademark Office*